United States Patent [19]

Odaka et al.

[11] Patent Number: 4,542,038

[45] Date of Patent: Sep. 17, 1985

[54] METHOD OF MANUFACTURING CATHODE-RAY TUBE

[75] Inventors: Yoshiyuki Odaka, Isumi; Kouichi Nakazato; Yoshifumi Tomita, both of Mobara, all of Japan

[73] Assignee: Hitachi, Ltd., Tokyo, Japan

[21] Appl. No.: 655,348

[22] Filed: Sep. 27, 1984

[30] Foreign Application Priority Data

Sep. 30, 1983 [JP] Japan ..... 58-180283

[51] Int. Cl.[4] ..... B05D 5/06; B05D 3/12

[52] U.S. Cl. ..... 427/68; 427/72

[58] Field of Search ..... 427/68, 72

[56] References Cited

U.S. PATENT DOCUMENTS 3,652,323 3/1972 Smith ..... 117/97

4,035,524 7/1977 Fritsch ..... 427/72 X 4,052,519 10/1977 Prazak ..... 427/72 X

*Primary Examiner*—James R. Hoffman

*Attorney, Agent, or Firm*—Charles E. Pfund

[57] ABSTRACT

A method of manufacturing a cathode-ray tube is provided, wherein in forming a phosphor screen on the inner surface of a faceplate of the cathode-ray tube, the inner surface of the faceplate faces downward while the faceplate is rotated about the axis of the cathode-ray tube, and a liquid material for forming a film is sprayed from a supply nozzle arranged to be substantially perpendicular to the inner surface of the faceplate so as to spray the liquid material on the inner surface of the faceplate along all directions, thereby forming a uniform film throughout the inner surface of the faceplate.

6 Claims, 6 Drawing Figures

METHOD OF MANUFACTURING CATHODE-RAY TUBE

BACKGROUND OF THE INVENTION

The present invention relates to a method of manufacturing a cathode-ray tube and, more particularly, to a method of coating a film forming liquid on an inner surface of a faceplate when a phosphor screen is formed on the inner surface of the faceplate.

In order to form a phosphor screen on an inner surface of a faceplate of a conventional cathode-ray tube, various film forming liquids are coated on the inner surface of the faceplate and are dried. For example, in a black matrix tube manufactured for improving brightness and contrast of the color picture tube, a dot or stripe pattern made of a polymer material is formed on the inner surface of the faceplate. Subsequently, a graphite suspension or slurry is coated on the dot or stripe pattern. The polymer material constituting the pattern is removed together with the overlying graphite film by a stripping agent or the like. Three color phosphors are coated along the window pattern from which the polymer material is removed.

In this case, the graphite suspension is coated on the inner surface of a faceplate 1 in a manner shown in FIG. 1. The inner surface of the faceplate 1 faces downward while the faceplate 1 is being rotated. A supply nozzle 2 sprays the graphite suspension at a large angle with respect to a normal to the inner surface, as described in Japanese Patent Publication No. 50-25496.

However, when the graphite film is formed on the inner surface of the faceplate 1 according to this method, irregular coating occurs especially at a spray start portion, as shown in FIG. 2. The jet is gradually sprayed along the inner surface of the faceplate while the faceplate is being rotated, so that a boundary between the first coated portion and a noncoated portion in front of the first coated portion does not change until the faceplate revolves once. The boundary portion becomes hardened during the time the faceplate revolves. When a jet is sprayed at the boundary portion again, a thickness of the boundary portion is increased. As a result, the boundary portion appears as an involute curve.

Another problem is presented by this conventional method. Since the graphite particles are flake-like particles, they are aligned along a graphite suspension flow. The resultant film has different glossy portions in accordance with the direction of the jet flow. At a boundary portion between a film portion obtained by first spraying of the suspension jet on the inner surface portion of the faceplate and a film portion obtained by subsequent spraying, the jet flow spreads, resulting in irregular coating.

SUMMARY OF THE INVENTION

The present invention has been made in consideration of the above situation, and has as its object to provide a method of manufacturing a cathode-ray tube, wherein a liquid material is uniformly coated on an inner surface of the faceplate to form a uniform film.

In order to achieve the above object of the present invention, the inner surface of the faceplate faces downward while the faceplate is being rotated, and a liquid material for forming a film is sprayed from a supply nozzle aligned to be substantially perpendicular to the inner surface, thereby uniformly flowing the liquid material in all directions toward the outer periphery on the inner surface of the faceplate.

DESCRIPTION OF THE PREFERRED EMBODIMENTS

EXAMPLE 1

Figure 1:
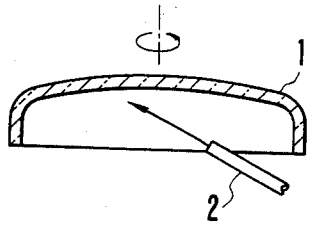
FIG. 1 is a sectional view showing a conventional method of coating a film on an inner surface of a faceplate.
Figure 2:
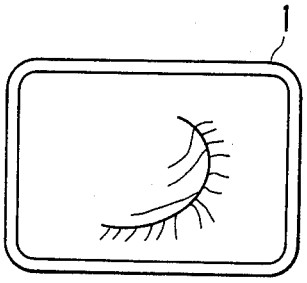
FIG. 2 is a view showing irregular coating when the conventional method in FIG. 1 is used.
Figure 3:
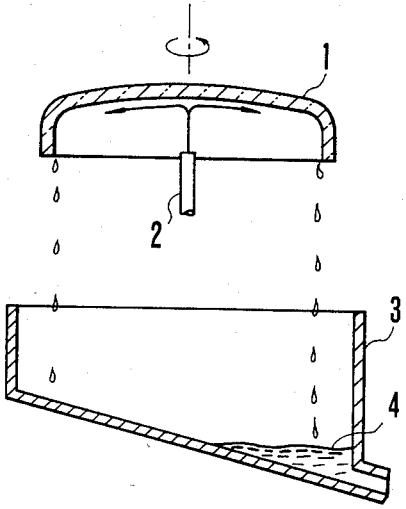
FIG. 3 is a sectional view showing a principle of a method of manufacturing a cathode-ray tube according to the present invention.
Figure 4:
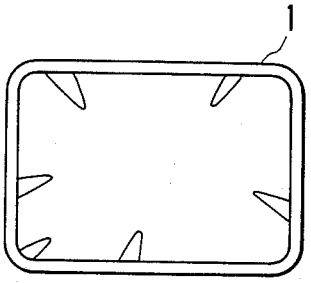
FIG. 4 is a view showing irregular coating when the faceplate shown in FIG. 3 is not rotated although the method in FIG. 3 is used.

The inner surface of a faceplate 1 having a diagonal length of 370 mm faced downward, as shown in FIG. 3. A supply nozzle 2 having an inner diameter 6 mm was arranged substantially on an axis of the cathode-ray tube. A graphite suspension (having a viscosity of 3 to 20 cp) was sprayed from the supply nozzle 2. When a flow rate of the suspension was adjusted to 8 l/min, the faceplate 1 needed not to be rotated to spread the flow of the liquid jet throughout the entire inner surface. As a result, a uniform film could be obtained. However, when the flow rate was decreased to 3 l/min, the jet was not spread to the peripheral portion of the inner surface, resulting in irregular coating shown in FIG. 4. However, when the faceplate 1 was rotated about the axis of the cathode-ray tube at a speed of 80 rpm, the suspension could be coated on the entire inner surface. When the flow rate was increased to over 120 l/min, the fluid sprayed on the inner surface of the faceplate was rebounded, resulting in irregular coating. However, when the diameter of the nozzle was increased, or a distance between the nozzle 2 and the faceplate 1 was increased, irregular coating could be prevented. However, the flow rate of 120 l/min was not a practical flow rate, as will be apparent from this Example and the following Examples. It should be noted that in FIG. 3 reference numeral 3 denotes a reservoir for recovering an excess fluid portion, and reference numeral 4 denotes a recovered fluid.

As is apparent from the above example, the liquid material for forming a film is sprayed vertically upward from the nozzle to the inner surface of the faceplate which faces downward, thereby forming a uniform film. More particularly, when the nozzle is arranged such that its axis is substantially on the axis of the cathode-ray tube, or a distance between the inner surface of the faceplate and the tip of the nozzle and a flow rate of the liquid material are properly selected, a uniform film is formed on the inner surface of the faceplate before rotating the faceplate once. Thus, productivity of the film is also increased. Since the liquid is sprayed vertically on the horizontal inner surface of the faceplate, the liquid does not become sprayed on the outer surface of the skirt portion.

EXAMPLE 2

Figure 5:
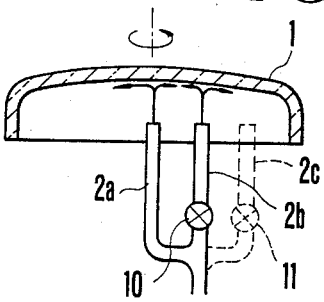
FIGS. 5 and 6 are sectional views showing other embodiments of the present invention.

As shown in FIG. 5, two nozzles 2*a* and 2*b* (each having an inner diameter of 6 mm) were arranged with respect to a faceplate 1 having a diagonal length of 370 mm. The axis of the nozzle 2*a* was arranged substantially on the axis of the cathode-ray tube. The nozzle 2*b* was parallel to the nozzle 2*a* and was spaced 80 mm apart therefrom. A phosphor suspension having a viscosity of 25 cp was sprayed from the nozzles 2*a* and 2*b*. A distance between the inner surface of the faceplate and the tips of the nozzles was 30 mm, and a flow rate of the phosphor per nozzle was 8 l/min. The suspension was sprayed from the nozzles 2*a* and 2*b* for 3 seconds while the faceplate 1 was rotated at a speed of 50 rpm. As a result, a uniform film was formed on the entire inner surface of the faceplate.

EXAMPLE 3

Figure 6:
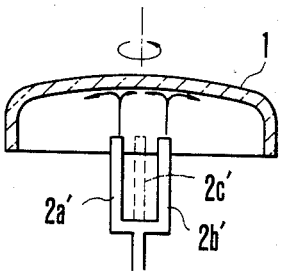

As shown in FIG. 6, nozzle pipes were branched from a main pipe, and two nozzles 2*a*′ and 2*b*′ were connected to these branched nozzle pipes. The two nozzles 2*a*′ and 2*b*′ were arranged symmetrically with each other with respect to a plane defined by the minor axis of the faceplate 1 and the axis of the cathode-ray tube. Each nozzle was spaced by 40 mm from the axis of the cathode-ray tube. When the phosphor suspension was coated in the same manner as in Example 2, a uniform film was obtained.

EXAMPLE 4

As shown in FIG. 6, nozzle pipes were branched from a main pipe, and two nozzles 2*a*′ and 2*b*′ were connected to these branched nozzle pipes. The two nozzles 2*a*′ and 2*b*′ were arranged symmetrically with each other with respect to a plane defined by the minor axis of the faceplate 1 and the axis of the cathode-ray tube. Each nozzle was spaced by 40 mm from the axis of the cathode-ray tube. A graphite suspension having a viscosity of 5 to 6 cp was sprayed from the nozzles 2*a*′ and 2*b*′. In this case, a flow rate of the suspension from each nozzle was 5 l/min, the faceplate 1 was rotated at a speed of 60 to 80 rpm, and a spraying time was 1.5 to 2.5 seconds. As a result, a uniform film was formed throughout the entire surface of each faceplate having different diagonal lengths between 190 mm and 356 mm.

EXAMPLE 5

As indicated by the dotted line in FIG. 6, another nozzle 2*c*′ was arranged substantially on the axis of the cathode ray tube. A suspension film of graphite was formed under the same conditions as in Example 4 for faceplates having diagonal lengths between 381 mm and 660 mm. In this case, a uniform film was formed on the entire inner surface of each faceplate. The nozzles 2*a*′, 2*b*′ and 2*c*′ were linearly aligned.

EXAMPLE 6

As shown in FIG. 3, a nozzle 2 was disposed under the faceplate 1 in such a manner that an axis of the nozzle 2 was arranged substantially on the axis of the cathode-ray tube. The nozzle 2 had an inner diameter of 9 mm. A distance between the inner surface of the faceplate 1 and the tip of the nozzle was 30 to 40 mm. A graphite suspension having a viscosity of 5 to 6 cp was sprayed from the nozzle 2 at a flow rate of 9 l/min for 2 seconds. In this case, the faceplate 1 was rotated at a speed of 50 to 80 rpm. As a result, a uniform film was formed on the entire inner surface of each faceplate having a diagonal length of 254 mm to about 355 mm.

EXAMPLE 7

As shown in FIG. 3, a nozzle 2 was disposed under the faceplate 1 in such a manner that the axis of the nozzle 2 was arranged substantially on the axis of the cathode-ray tube. The nozzle 2 had an inner diameter of 6 mm. A distance between the inner surface of the faceplate 1 and the tip of the nozzle was 30 to 40 mm. A precoat solution (mixture of an acrylic emulsion and a water-soluble polymer resin) having a viscosity of 3.0 cp was sprayed from the nozzle 2 at a flow rate of 5 l/min for 7 seconds. In this case, the faceplate 1 was rotated at a speed of 30 to 80 rpm. As a result, a uniform film was formed on the entire inner surface of each faceplate having a diagonal length of 254 mm to about 558 mm.

EXAMPLE 8

As shown in FIG. 3, a nozzle 2 was disposed under the faceplate 1 in such a manner that the axis of the nozzle 2 was arranged substantially on the axis of the cathode-ray tube. The nozzle 2 had an inner diameter of 9 mm. A distance between the inner surface of the faceplate 1 and the tip of the nozzle was 30 mm. A graphite suspension having a viscosity of 5 to 6 cp was sprayed from the nozzle 2 at a flow rate of 9 l/min for 2 seconds. In this case, the faceplate 1 was rotated at a speed of 60 rpm. As a result, a uniform film was formed on the entire inner surface of each faceplate having a diagonal length of about 355 mm.

The above Examples are summarized in the following manner. The viscosity and the flow rate of the spray liquid, the nozzle diameter, the rotational frequency of the faceplate, the distance between the nozzle tip and the inner surface of the faceplate, and the like are selected in accordance with the size of the faceplate and the type of spray liquid. The respective values are given in accordance with the test results:

Faceplate dimension (diagonal length): about 127 to about 660 mm

Liquid material: graphite suspension, precoat solution, water-soluble polymer solution phosphor, etc.

Liquid viscosity: 1 to 80 cp

Flow rate: 0.2 to 90 l/min

Nozzle diameter: 1 to 30 mm

Faceplate rotation: about 0.25 to about 250 rpm

Distance between nozzle tip and inner surface: 5 to 500 mm.

The present invention is not limited to the above embodiments. Various changes and modifications may be made within the spirit and scope of the invention. For example, a valve 10 may be arranged in the nozzle 2*b* in FIG. 5. When the valve 10 is closed, only the nozzle 2*a* can be used. When the valve 10 is opened, both the nozzles 2*a* and 2*b* can be used. In addition, when the valve 10 is partially closed to decrease the flow rate of the nozzle 2*b*, the nozzle 2*c* may be arranged as in the arrangement in FIG. 5. In this case, a valve 11 may be arranged in the nozzle 2*c*. The nozzle 2*c* may be linearly aligned with the nozzles 2*a* and 2*b*. In a practical apparatus, a nozzle is preferably movable along the axial direction of the cathode-ray tube.

What is claimed is:

1. A method of manufacturing a cathode-ray tube, wherein in forming a phosphor screen on an inner surface of a faceplate of the cathode-ray tube, the inner surface of the faceplate faces downward while the faceplate is rotated about an axis of the cathode-ray tube, and a liquid material for forming a film is sprayed from a supply nozzle arranged to be substantially perpendicular to the inner surface of the faceplate so as to spray the liquid material on the inner surface of the faceplate along all directions, thereby forming a uniform film throughout the inner surface of the faceplate.

2. A method according to claim 1, wherein the supply nozzle comprises a single nozzle arranged substantially on the axis of the cathode-ray tube.

3. A method according to claim 1, wherein the supply nozzle comprises a plurality of nozzles arranged symmetrically with each other substantially with respect to the axis of the cathode-ray tube.

4. A method according to claim 3, further comprising an additional nozzle arranged substantially on the axis of the cathode-ray tube.

5. A method according to claim 4, wherein the plurality of nozzles are aligned in line.

6. A method according to claim 3, wherein the plurality of nozzles include at least two nozzles one of which is arranged substantially on the axis of the cathode-ray tube and another of which is spaced by a predetermined distance from the axis of the cathode-ray tube.

* * * * *